US010674759B2

(12) United States Patent
Hopkins et al.

(10) Patent No.: US 10,674,759 B2
(45) Date of Patent: Jun. 9, 2020

(54) TOBACCO SMOKING AID

(71) Applicants: Tressa Hopkins, Chester, SC (US); Althonso Hopkins, Chester, SC (US)

(72) Inventors: Tressa Hopkins, Chester, SC (US); Althonso Hopkins, Chester, SC (US)

( * ) Notice: Subject to any disclaimer, the term of this patent is extended or adjusted under 35 U.S.C. 154(b) by 74 days.

(21) Appl. No.: 15/897,626

(22) Filed: Feb. 15, 2018

(65) Prior Publication Data

US 2019/0246688 A1 Aug. 15, 2019

(51) Int. Cl.
*A24D 1/04* (2006.01)
*A24D 1/02* (2006.01)

(52) U.S. Cl.
CPC ..... *A24D 1/045* (2013.01); *A24D 1/022* (2013.01); *A24D 1/042* (2013.01)

(58) Field of Classification Search
CPC .... A24C 5/40; A24C 5/42; A24D 1/04; A24D 3/18
See application file for complete search history.

(56) References Cited

U.S. PATENT DOCUMENTS

| | | | | |
|---|---|---|---|---|
| 3,294,095 | A * | 12/1966 | Ackerman | A24D 1/045 131/361 |
| 5,197,495 | A | 3/1993 | Ruppert et al. | |
| 5,762,074 | A | 6/1998 | Garner | |
| D526,086 | S | 8/2006 | Mehta | |
| 8,393,335 | B1 | 3/2013 | Sinclair, Jr. | |
| 9,433,240 | B2 | 9/2016 | Sinclair, Jr. | |
| 2009/0032039 | A1* | 2/2009 | Santa | A24C 5/40 131/353 |
| 2010/0154808 | A1* | 6/2010 | Boll | A24D 1/00 131/58 |
| 2015/0020819 | A1 | 1/2015 | Barrett | |
| 2016/0088871 | A1* | 3/2016 | Sinclair, Jr. | A24C 5/40 131/281 |
| 2016/0366930 | A1 | 12/2016 | Tully | |

* cited by examiner

*Primary Examiner* — Eric Yaary

(57) ABSTRACT

A tobacco smoking aid for tobacco users includes a tobacco leaf that is rolled to define a tube. The tube has a first end and a second end that are open. A filter is coupled to and extends from the first end of the tube. The tube is configured to insert a substance through the second end into an interior space defined by the tube. The filter is configured to insert between lips of a user to position the second end of the tube for lighting. Smoke from burning of the tobacco leaf and the substance passes through the filter into lungs of the user.

5 Claims, 3 Drawing Sheets

TOBACCO SMOKING AID

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to smoking aids and more particularly pertains to a new smoking aid for tobacco users.

BRIEF SUMMARY OF THE INVENTION

An embodiment of the disclosure meets the needs presented above by generally comprising a tobacco leaf that is rolled to define a tube. The tube has a first end and a second end that are open. A filter is coupled to and extends from the first end of the tube. The tube is configured to insert a substance through the second end into an interior space defined by the tube. The filter is configured to insert between lips of a user to position the second end of the tube for lighting. Smoke from burning of the tobacco leaf and the substance passes through the filter into lungs of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
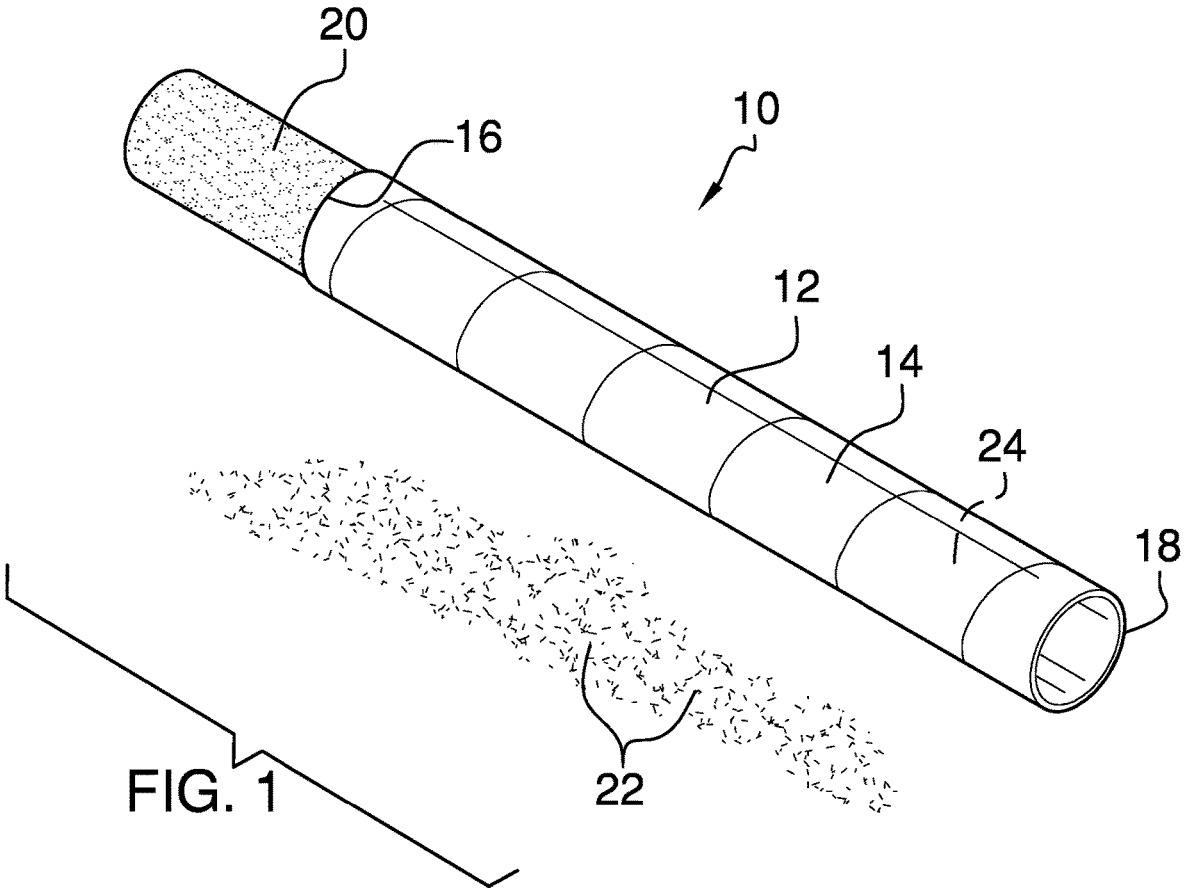
FIG. 1 is an isometric perspective view of a tobacco smoking aid according to an embodiment of the disclosure.
Figure 2:
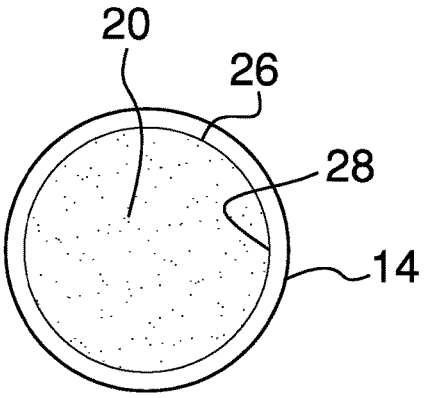
FIG. 2 is an end view of an embodiment of the disclosure.
Figure 3:
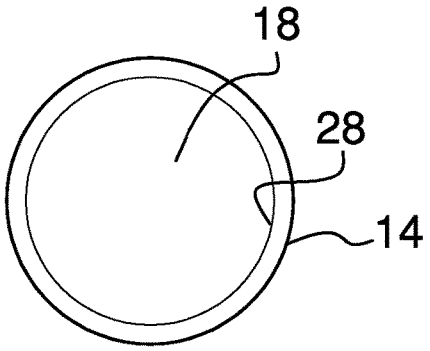
FIG. 3 is an end view of an embodiment of the disclosure.

With reference now to the drawings, and in particular to FIGS. 1 through 5 thereof, a new smoking aid embodying the principles and concepts of an embodiment of the disclosure and generally designated by the reference numeral 10 will be described.

As best illustrated in FIGS. 1 through 5, the tobacco smoking aid 10 generally comprises a tobacco leaf 12 that is rolled to define a tube 14. The tube 14 has a first end 16 and a second end 18 that are open.

A filter 20 is coupled to and extends from the first end 16 of the tube 14. The tube 14 is configured to insert a substance 22 through the second end 18 into an interior space 24 defined by the tube 14. The filter 20 is configured to insert between lips of a user to position the second end 18 of the tube 14 for lighting. Smoke from burning of the tobacco leaf 12 and the substance 22 passes through the filter 20 into lungs of the user. The substance 22 comprises a single type of tobacco, a mixture or blend of different types of tobacco, or the like. The filter 20 enhances the smoking experience by filtering the smoke before the smoke enters the lungs of the user.

The filter 20 is cylindrically shaped. An outer circumference 26 of the filter 20 is complementary to an inner perimeter 28 of the tube 14. The filter 20 is positioned for partial insertion into the first end 16 of the tube 14. A first section 30 of the filter 20 is frictionally coupled to the tube 14. A second section 32 of the filter 20 protrudes from the first end 16 of the tube 14. The filter 20 is adhesively coupled to the tube 14.

The present invention anticipates methods of manufacturing the tube 14 and for coupling the tube 14 to the filter 20. The present invention also anticipates packaging that is designed to maintain the integrity of the tube 14 between manufacturing and delivery to the user. The present invention also anticipates the tube 14 being supplied to the user with the substance 22 already positioned in the interior space 24.

Figure 4:
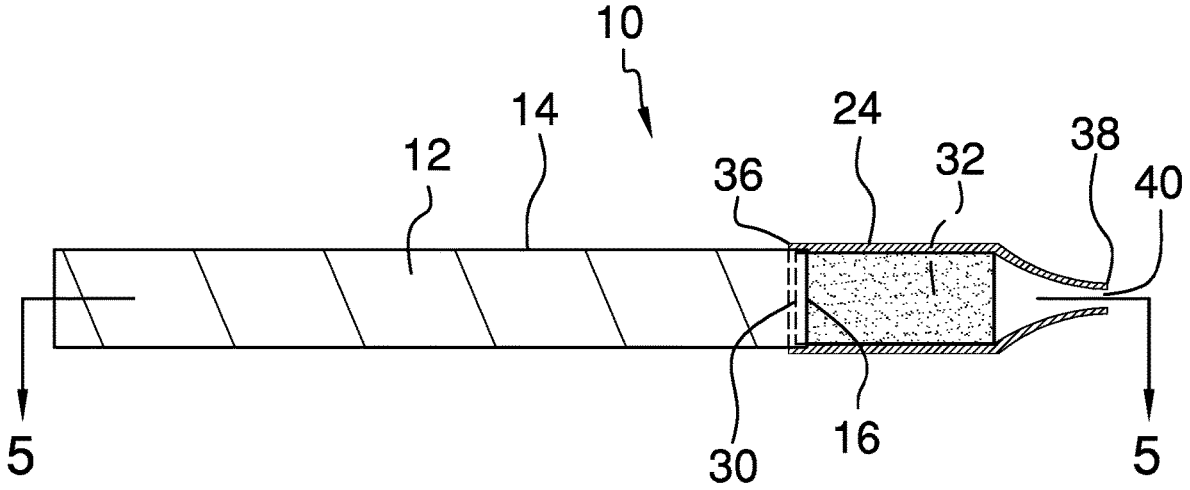
FIG. 4 is a side view of an embodiment of the disclosure.
Figure 5:
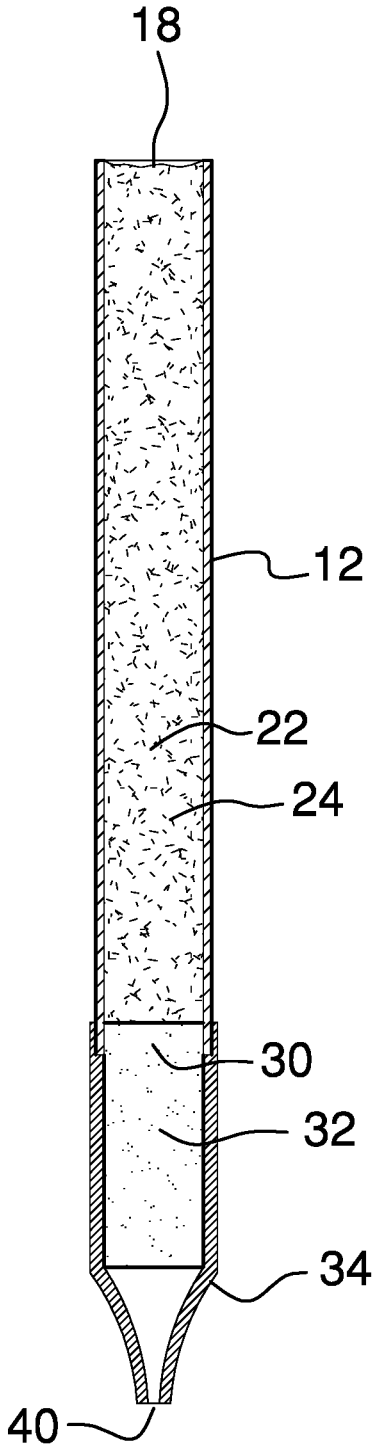
FIG. 5 is a cross-sectional view of an embodiment of the disclosure.

In one embodiment of the invention, as shown in FIGS. 4 and 5, a shell 34 is positioned over the filter 20. The shell 34 has a first endpoint 36 that is coupled to the tube 14 proximate to the first end 16. The first end 16 of the tube 14 is positioned between the filter 20 and the shell 34. The shell 34 has a second endpoint 38 that is tapered so that the second endpoint 38 of the shell 34 is configured to position between the lips of the user. The shell 34 is adhesively coupled to the tube 14.

A slot 40 is positioned through the second endpoint 38 of the shell 34. The smoke from the burning of the tobacco leaf 12 and the substance 22 passes through the filter 20 and the slot 40 into the lungs of the user.

In use, the tube 14 is configured to insert the substance 22 through the second end 18 into the interior space 24. The shell 34 is configured to insert between the lips of the user to position the second end 18 of the tube 14 for lighting. The smoke from the burning of the tobacco leaf 12 and the substance 22 passes through the filter 20 and the slot 40 into the lungs of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A tobacco smoking aid comprising:

a tobacco leaf, said tobacco leaf being rolled such that said tobacco leaf defines a tube, said tube having a first end and a second end, said first end and said second end being open;

a filter coupled to and extending from said first end of said tube, said filter being cylindrically shaped such that an outer circumference of said filter is complementary to an inner perimeter of said tube positioning said filter for partially inserting into said first end of said tube such that a first section of said filter is frictionally coupled to said tube and such that a second section of said filter protrudes from said first end of said tube; and wherein said filter is positioned on said tube such that said tube is configured for inserting a substance through said second end into an interior space defined by said tube, such that said filter is configured for inserting between lips of a user positioning said second end of said tube for lighting such that smoke from burning of said tobacco leaf and said substance passes through said filter into lungs of the user;

a shell positioned over said filter, said shell having a first endpoint coupled to said tube proximate to said first end such that said first end of said tube is positioned between said filter and said shell, said shell having a second endpoint, said second endpoint being tapered such that said second endpoint of said shell is configured for positioning between the lips of the user, said shell having a recess extending into said first endpoint of said shell defining a lip positioned in spaced relationship to said filter, an inwardly facing surface of said lip abutting said tube, an interior face of said shell extending from said recess towards said second endpoint abutting said filter; and a slot positioned through said second endpoint of said shell, wherein said slot is positioned through said shell such that the smoke from the burning of said tobacco leaf and said substance passes through said filter and said slot into the lungs of the user.

2. The aid of claim 1, further including said filter being adhesively coupled to said tube.

3. The aid of claim 1, further including said substance comprising tobacco.

4. The aid of claim 1, further including said shell being adhesively coupled to said tube.

5. A tobacco smoking aid comprising:

a tobacco leaf, said tobacco leaf being rolled such that said tobacco leaf defines a tube, said tube having a first end and a second end, said first end and said second end being open;

a filter coupled to and extending from said first end of said tube, wherein said filter is positioned on said tube such that said tube is configured for inserting a substance through said second end into an interior space defined by said tube, such that said filter is configured for inserting between lips of a user positioning said second end of said tube for lighting such that smoke from burning of said tobacco leaf and said substance passes through said filter into lungs of the user, said filter being cylindrically shaped such that an outer circumference of said filter is complementary to an inner perimeter of said tube positioning said filter for partially inserting into said first end of said tube such that a first section of said filter is frictionally coupled to said tube and such that a second section of said filter protrudes from said first end of said tube, said filter being adhesively coupled to said tube, said substance comprising tobacco;

a shell positioned over said filter, said shell having a first endpoint coupled to said tube proximate to said first end such that said first end of said tube is positioned between said filter and said shell, said shell having a second endpoint, said second endpoint being tapered such that said second endpoint of said shell is configured for positioning between the lips of the user, said shell having a recess extending into said first endpoint of said shell defining a lip positioned in spaced relationship to said filter, an inwardly facing surface of said lip abutting said tube, an interior face of said shell extending from said recess towards said second endpoint abutting said filter, said shell being adhesively coupled to said tube;

a slot positioned through said second endpoint of said shell, wherein said slot is positioned through said shell such that the smoke from the burning of said tobacco leaf and said substance passes through said filter and said slot into the lungs of the user; and wherein said filter is positioned on said tube such that said tube is configured for inserting the substance through said second end into said interior space, such that said shell is configured for inserting between the lips of the user positioning said second end of said tube for lighting such that the smoke from the burning of said tobacco leaf and said substance passes through said filter and said slot into the lungs of the user.

* * * * *